US005513690A

United States Patent [19]

Matsubayashi et al.

[11] Patent Number: 5,513,690

[45] Date of Patent: May 7, 1996

[54] LOW-PRESSURE CASTING APPARATUS

[75] Inventors: Nobuyuki Matsubayashi; Koji Tomiya, both of Hiroshima, Japan

[73] Assignee: Mazda Motor Corporation, Hiroshima, Japan

[21] Appl. No.: 403,664

[22] Filed: Mar. 14, 1995

[30] Foreign Application Priority Data

Mar. 23, 1994 [JP] Japan ..... 6-051497

[51] Int. Cl.[6] ..... B22D 18/04

[52] U.S. Cl. ..... 164/306; 164/337

[58] Field of Search ..... 164/306, 309, 164/337, 119

[56] References Cited

U.S. PATENT DOCUMENTS

| | | | |
|---|---|---|---|
| 3,727,674 | 4/1973 | Chatourel et al. | 164/306 |
| 3,880,222 | 4/1975 | Chatourel et al. | 164/337 X |
| 4,076,070 | 2/1978 | Lefebure et al. | 164/306 X |
| 4,180,121 | 12/1979 | Lefebure | 164/306 X |

FOREIGN PATENT DOCUMENTS

| | | | |
|---|---|---|---|
| 54-115631 | 9/1979 | Japan | 164/309 |
| 4-6359 | 1/1992 | Japan . | |
| 1156839 | 5/1985 | U.S.S.R. | 164/306 |

*Primary Examiner*—J. Reed Batten, Jr.

*Attorney, Agent, or Firm*—Sixbey, Friedman, Leedom & Ferguson; Gerald J. Ferguson, Jr.

[57] ABSTRACT

A low-pressure casting apparatus includes a casting mold having upper and lower molds, a lower mold platen to which the lower mold is fixed, a molten metal holding furnace which holds molten metal to be supplied to a cavity in the casting mold and is disposed in a position offset from the casting mold, a cutaway portion which is formed in the lower mold platen to open toward the furnace and a molten metal supply pipe which extends obliquely upward through the cutaway portion from the furnace to the lower mold to connect the furnace to the cavity. The molten metal supply pipe is arranged to connect the casting mold and the furnace with the molten metal supply pipe supported on a support table and the support table is provided with a pressing mechanism which presses the pipe against the furnace to connect the furnace-side end of the pipe to the furnace.

2 Claims, 4 Drawing Sheets

LOW-PRESSURE CASTING APPARATUS

FIELD OF THE INVENTION

This invention relates to a low-pressure casting apparatus.

DESCRIPTION OF THE PRIOR ART

There has been known a low-pressure casting apparatus in which molten metal in a holding furnace is supplied to a cavity in a casting mold through a molten metal supply pipe under a pressure.

In conventional low-pressure casting apparatuses, since the molten metal holding furnace is positioned just below the casting mold and the molten metal supply pipe extends upward from the furnace, the casting mold is positioned high. Accordingly the conventional low-pressure casting apparatuses are disadvantageous in that the cast product cannot be taken out from the casting mold unless the space where the low-pressure casting apparatus is positioned has a sufficient height and that the space below the casting mold cannot be used.

We have proposed a low-pressure casting apparatus in which a molten metal holding furnace is mounted for up-and-down movement on a truck, which is movable in a horizontal direction, in a position offset from the casting mold, and a molten metal supply pipe fixed to the furnace extends obliquely upward through a cutaway portion formed in a lower mold platen to open toward the furnace and is connected to the casting mold. (See Japanese Unexamined Utility Model Publication No. 4(1992)-6359.)

However the arrangement is disadvantageous in that since the molten metal supply pipe which obliquely extends from the furnace is fixed to the furnace by fastening means such as bolts, it takes a lot of time to mount and demount the supply pipe on and from the furnace for cleaning of the pipe or the like.

SUMMARY OF THE INVENTION

In view of the foregoing observations and description, the primary object of the present invention is to provide a low-pressure casting apparatus in which the molten metal supply pipe can be easily mounted and demounted on and from the furnace.

A low-pressure casting apparatus in accordance with the present invention comprises a casting mold having upper and lower molds, a lower mold platen to which the lower mold is fixed, a molten metal holding furnace which holds molten metal to be supplied to a cavity in the casting mold and is disposed in a position offset from the casting mold, a cutaway portion which is formed in the lower mold platen to open toward the furnace and a molten metal supply pipe means which extends obliquely upward through the cutaway portion from the furnace to the lower mold to connect the furnace to the cavity, and is characterized in that said molten metal supply pipe means is arranged to connect the casting mold and the furnace with the molten metal supply pipe means supported on a support means and the support means is provided with a pressing means which presses the pipe means against the furnace to connect the furnace-side end of the pipe means to the furnace.

Preferably said molten metal holding furnace and the said support means are provided on a common movable truck which can be horizontally moved.

In the low-pressure casting apparatus of the present invention, the molten metal supply pipe means is not fixed to the furnace but is connected to the furnace by simply pressing the end of the pipe means against the furnace by the pressing means with the pipe means supported on the support means. Accordingly, the molten metal supply pipe means can be easily removed from the furnace, for instance, when the pipe means is to be cleaned, whereby cleaning or the like of the pipe means can be done in a short time.

DESCRIPTION OF THE PREFERRED EMBODIMENT

Figure 1:
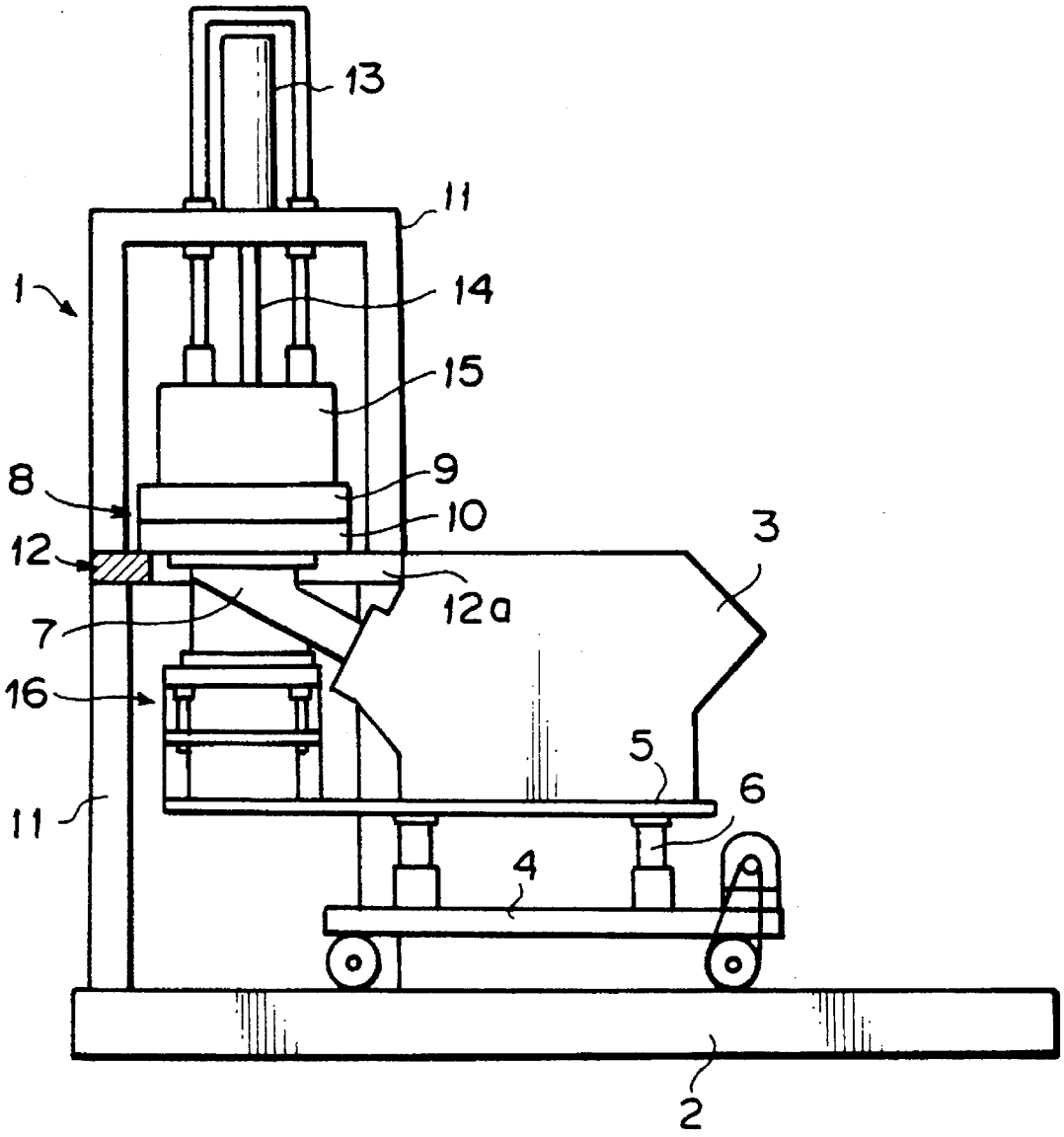
FIG. 1 is a front view of a low-pressure casting apparatus in accordance with an embodiment of the present invention.

In FIG. 1, a low-pressure casting apparatus 1 in accordance with an embodiment of the present invention is installed on a base 2, and a molten metal holding furnace 3 is mounted on an electrically-driven truck 4 which is horizontally movable on the base 2. A table 5 is horizontally supported on the truck 4 by jacks 6 and is moved up and down by the jacks 6. The furnace 3 is placed on the table 5 to be moved up and down by the jacks 6.

A casting mold 8 comprises upper and lower molds 9 and 10. A frame work 11 is installed on the base 2 and a lower mold platen 12 is mounted on the frame work 11. The lower mold 10 is fixed to the lower mold platen 12. An upper mold platen 15 is mounted on the lower end of a piston rod 14 of a cylinder 13 and driven up and down by the piston rod 14. The upper mold 9 is fixed to the upper mold platen 15. The furnace 3 is placed in a position offset from the casting mold 8.

A molten metal supply pipe 7 for supplying molten metal in the furnace 3 to a cavity (not shown) formed by the casting mold 8 is connected between the furnace 3 and the casting mold 8. The supply pipe 7 is supported by a support table 16 mounted on the table 5 and is not fixed to the furnace 3. The supply pipe 7 extends obliquely upward from the furnace 3 through a cutaway portion **12*a* formed in the lower mold platen 12 and is connected to the cavity in the casting mold 8. The cutaway portion 12*a* opens at the right side end or the end facing the furnace 3**.

Figure 2:
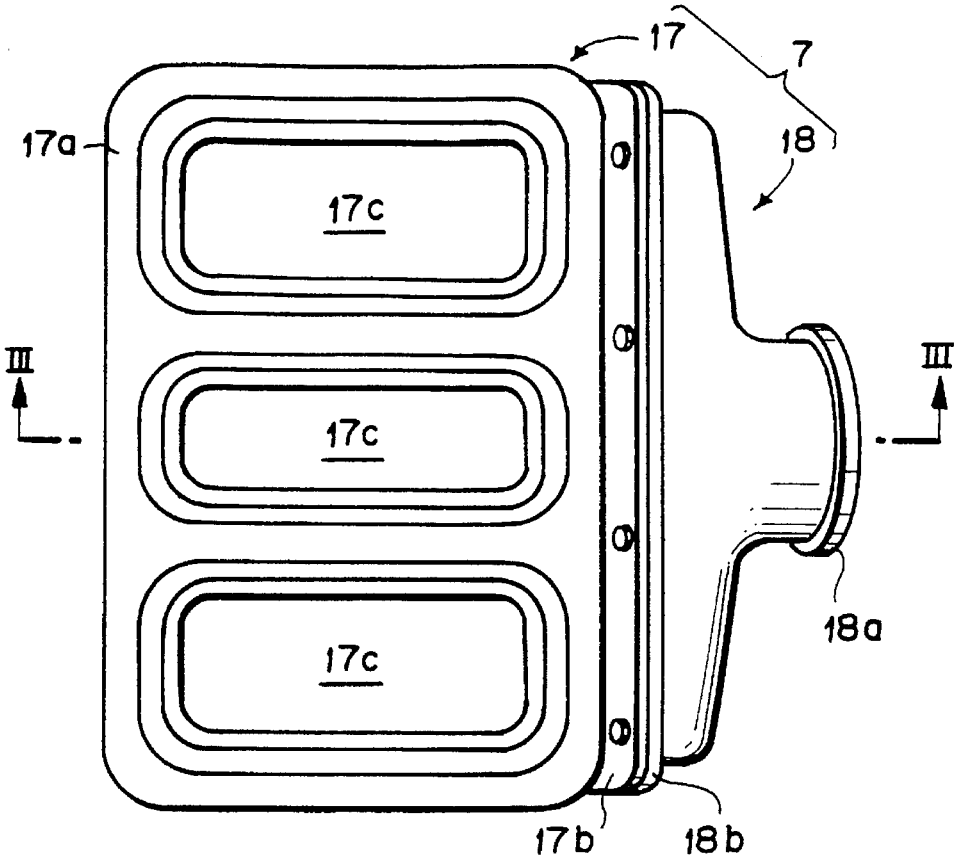
FIG. 2 is a plan view of the molten metal supply pipe.
Figure 3:
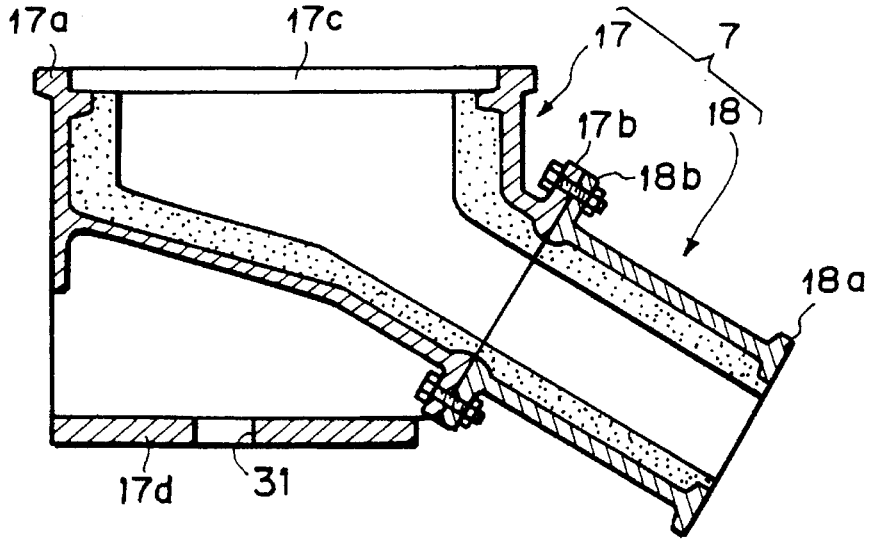
FIG. 3 is a cross-sectional view taken along line III—III in FIG. 2.
Figure 4:
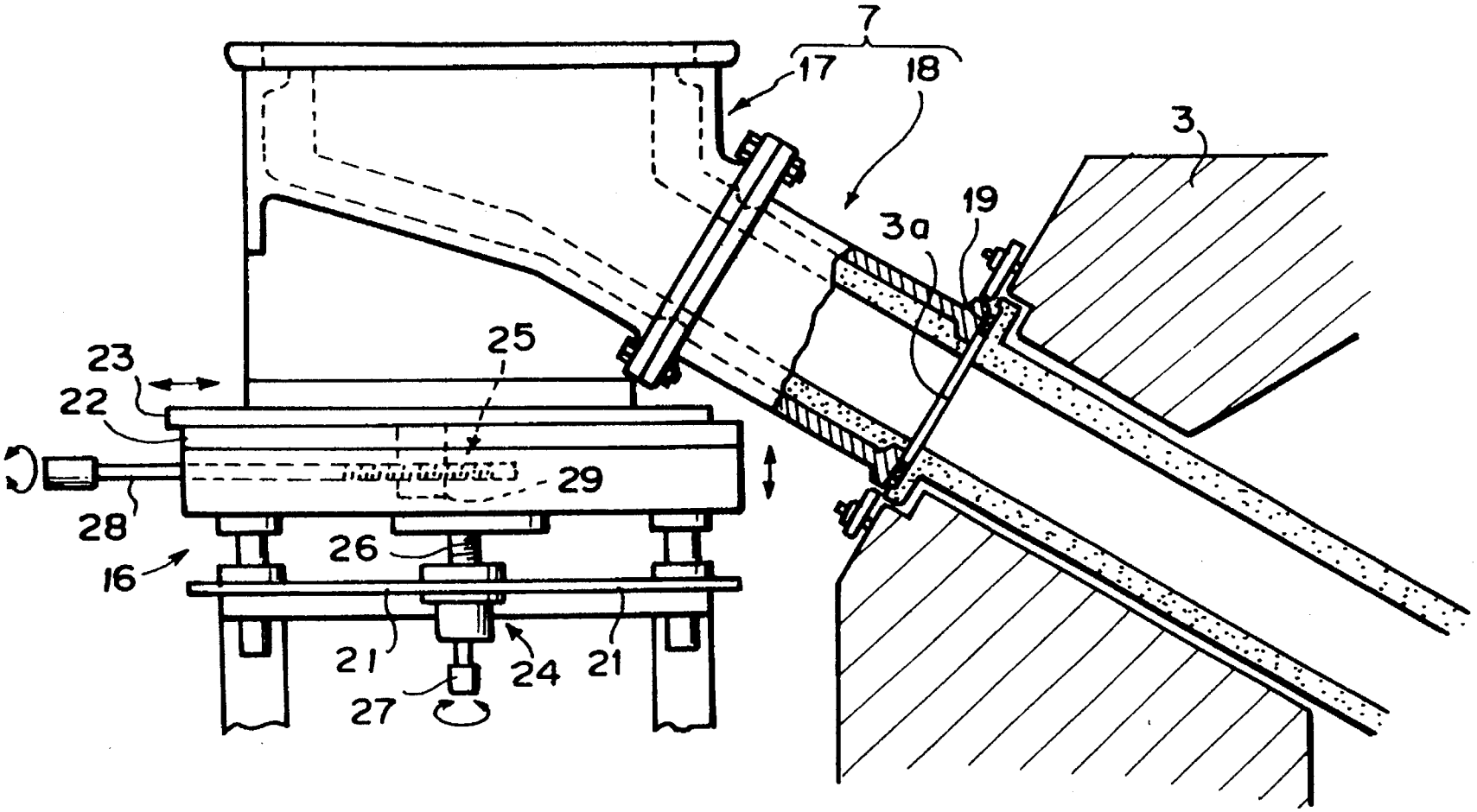
FIG. 4 is a fragmentary front view partly in cross-section showing the state where the molten metal supply pipe is connected to the furnace.

As shown in FIGS. 2 and 3, the supply pipe 7 comprises first and second parts 17 and 18 joined together. The first part 17 is provided with a rectangular upper flange **17*a* and a rectangular lower flange 17*b* at its upper and lower ends, respectively. Further, metal feed openings 17*c* are provided in the upper flange 17*a*. The second part 18 is provided with a circular lower flange 18*a* and a rectangular upper flange 18*b* at its upper and lower ends as shown in FIG. 4. The upper flange 17*a* of the first part 17 is pressed against the lower surface of the lower mold 10 to connect the supply pipe 7 to the cavity and the lower flange 17*b* is connected to the upper flange 18*b* of the second part 18 by bolts. The lower flange 18*a* of the second part 18 is pressed against the outer surface of the furnace 3 about an inclined molten metal supply port 3***a* of the furnace 3 to connect the supply pipe 7 to the supply port 3*a*. A seal member 19 is provided around the supply port 3*a* to seal the joint between the lower flange 18*a* and the outer surface of the furnace 3 about the molten metal supply port 3*a*.

Figure 5:
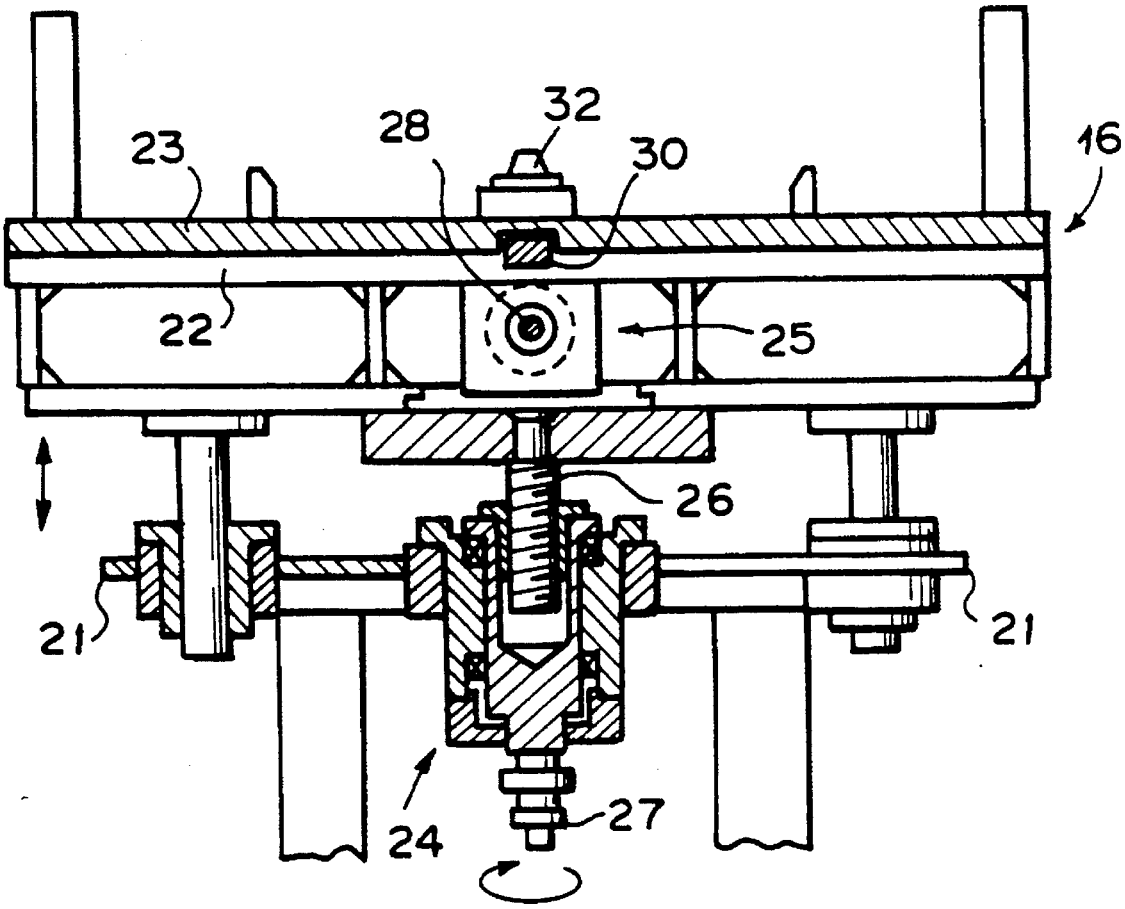
FIG. 5 is a fragmentary side view partly in cross-section showing the support table.

As shown in FIGS. 4 and 5, the support table 16 comprises a first base plate 21 fixed to the table 5, a second base plate 22 mounted on the first base plate 21 to be movable up and down, a third base plate 23 mounted on the second base plate 22 to be slidable toward and away from the furnace 3, an up-and-down mechanism 24 for the second base plate 22 and a sliding mechanism 25 for the third base plate 23.

The up-and-down mechanism 24 comprises a screw rod 26 which is provided with a male screw on the outer surface thereof and extends downward from the lower surface of the second base plate 22, and an actuator rod 27 which is mounted on the first base plate 21 for rotation about a vertical axis and is provided on the inner surface thereof with a female screw which is in mesh with the male screw on the screw rod 26. When the actuator rod 27 is rotated in one direction, the second base plate 22 is moved upward and when the actuator rod 27 is rotated in the reverse direction the second base plate 22 is moved downward.

The sliding mechanism 25 for the third base plate 23 comprises an actuator rod 28 which is mounted on the second base plate 22 for rotation about a horizontal axis and is provided on the outer surface thereof with a male screw, an engagement member 29 which is provided with a threaded hole having a female screw on the inner surface thereof and extends downward from the lower surface of the third base plate 23 with the female screw in mesh with the male screw on the actuator rod 28 and a guide rail 30 disposed between the second base plate 22 and the third base plate 23. When the actuator rod 28 is rotated in one direction, the third base plate 23 is moved toward the furnace 3 and when the actuator rod 28 is rotated in the reverse direction the third base plate 23 is moved away from the furnace 3.

A locator hole 31 is formed in a bottom wall of a skirt portion 17*d* of the first part 17 of the supply pipe 7 and a projection 32 adapted to be engaged with the locator hole 31 is provided to project upward from the upper surface of the third base plate 23. By engaging the projection 32 with the locator hole 31, the supply pipe 7 is located in a predetermined position with respect to the third base plate 23. The supply pipe 7 supported on the support table 16 is moved rightward downward (as seen in FIG. 4) by operation of the actuator rods 27 and 28 so that the lower flange 18*a* of the second part 18 is pressed against the outer surface of the furnace 3 about the molten metal supply port 3*a* of the furnace 3 to connect the supply pipe 7 to the supply port 3*a*.

After the supply pipe 7 is thus connected to the furnace 3, the truck 4 carrying thereon the support table 16 and the furnace 3 is moved so that the supply pipe 7 and the furnace 3 are positioned in a predetermined position with respect to the casting mold 8. Then the furnace 3 and the pipe 7 are slightly lifted by the jacks 6, whereby the upper flange 17*a* of the first part 17 of the pipe 7 is pressed against the lower surface of the lower mold 10 and the pipe 7 is connected to the cavity in the casting mold 8. Thereafter the upper mold 9 is set on the lower mold 10 to form the cavity and the molten metal in the furnace 3 is pressurized by air or inert gas to be fed into the cavity through the pipe 7.

As can be understood from the description above, in the low-pressure casting apparatus 1 of this embodiment, the molten metal supply pipe 7 is not fixed to the furnace 3 but is connected to the furnace 3 by simply pressing the end of the pipe 7 against the furnace 3 by the pressing means (the up-and-down mechanism 24 and the sliding mechanism 25) with the pipe 7 supported on the support table 16. Accordingly, the molten metal supply pipe 7 can be easily removed from the furnace 3, for instance, when the pipe 7 is to be cleaned, whereby cleaning or the like of the pipe 7 can be done in a short time.

What is claimed is:

1. In a low-pressure casting apparatus comprising a casting mold having upper and lower molds, a lower mold platen to which the lower mold is fixed, a molten metal holding furnace which holds molten metal to be supplied to a cavity in the casting mold and is disposed in a position offset from the casting mold, a cutaway portion which is formed in the lower mold platen to open toward the furnace and a molten metal supply pipe means which extends obliquely upward through the cutaway portion from the furnace to the lower mold to connect the furnace to the cavity, the improvement comprising:

a support means for supporting the molten metal supply pipe means and the support means is provided with a pressing means which presses the pipe means against the furnace to connect the furnace-side end of the pipe means to the furnace.

2. A low-pressure casting apparatus as defined in claim 1 in which said molten metal holding furnace and the said support means are provided on a common movable truck which can be horizontally moved.

* * * * *